United States Patent [19]

Roe

[11] 4,262,466

[45] Apr. 21, 1981

[54] ROOFING TILES

[75] Inventor: Vernon S. Roe, Redhill, England

[73] Assignee: Redland Roof Tiles Limited, Surrey, England

[21] Appl. No.: 7,174

[22] Filed: Jan. 29, 1979

[30] Foreign Application Priority Data

Jan. 27, 1978 [GB] United Kingdom ..... 3485/78

[51] Int. Cl.[3] ..... E04D 1/00; E04D 1/34

[52] U.S. Cl. ..... 52/550; 52/533; 52/536; 52/552; 52/554

[58] Field of Search ..... 52/550, 552, 98, 100, 52/554, 533, 536

[56] References Cited

U.S. PATENT DOCUMENTS

| | | | |
|---|---|---|---|
| Re. 16,415 | 9/1926 | Warren | 52/550 |
| 777,058 | 12/1904 | Mitchell | 52/550 X |
| 1,370,716 | 3/1921 | Tromm | 52/550 X |
| 1,824,471 | 9/1931 | Fischer | 52/554 |
| 4,040,211 | 8/1977 | Wotherspoon | 52/100 |

FOREIGN PATENT DOCUMENTS

| | | | |
|---|---|---|---|
| 149633 | 12/1931 | Switzerland | 52/554 |
| 3083 | of 1893 | United Kingdom | 52/550 |
| 657208 | 9/1951 | United Kingdom | 52/552 |

*Primary Examiner*—Alfred C. Perham

*Attorney, Agent, or Firm*—Young & Thompson

[57] ABSTRACT

A moulded concrete roofing tile has at least two projecting nibs on the underside of the tile which nibs are spaced apart along the length of the tile. The tile may therefore be hung on a batten from either nib. An edge portion of the tile is cut away to receive a portion of a second tile in a vertical row adjacent a vertical row occupied by the said tile and staggered with regard to the said tile. In this way a horizontal row of tiles may be hung on a single batten with adjacent tiles in the row being displaced vertically in relation to one another and a roof may be constructed with the tiles in adjacent rows staggered but using only the same number and spacing of battens as would be required for rows which are not so arranged.

6 Claims, 14 Drawing Figures

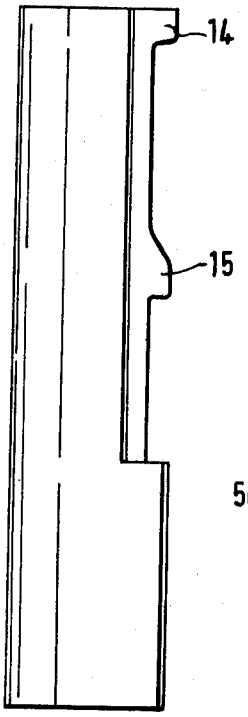
FIG.6.
FIG.7.
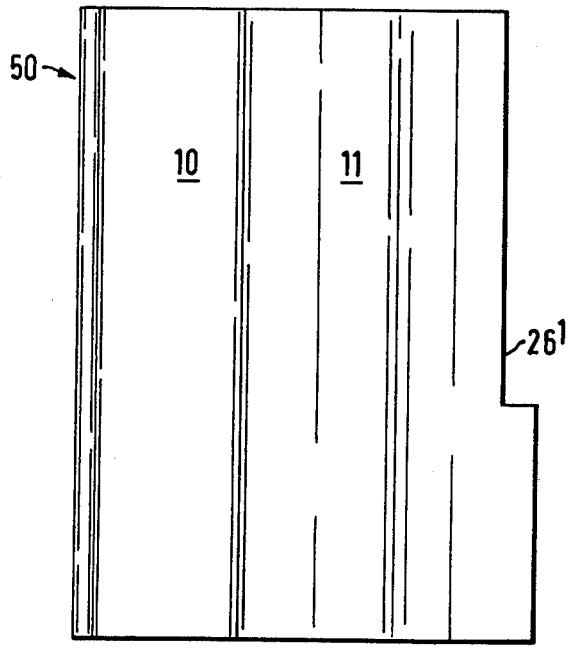
FIG.8.
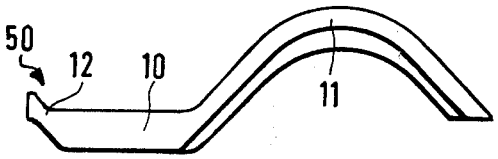

ROOFING TILES

The invention relates to moulded concrete roofing tiles and to roofs made with such tiles.

The invention provides a moulded concrete roofing tile having at least two projecting nibs on the underside of the tile which nibs are spaced apart along the length of the tile whereby the tile may be hung on a batten from either nib, an edge portion of the tile being cut away to receive a portion of a second tile in a vertical row adjacent a vertical row occupied by the said tile and staggered with regard to the said tile. In this way a horizontal row of tiles may be hung on a single batten with adjacent tiles in the row being displaced vertically in relation to one another and a roof may be constructed with the tiles in adjacent rows staggered but using only the same number and spacing of battens as would be required for rows which are not so arranged.

The tile may comprise a flat portion and a roll portion in side-by-side relation and the flat portion may have an upturned edge. Preferably the edge portion which is cut away is on the roll portion.

Preferably the nibs are formed on the underside of the flat portion of the tile, one being adjacent an end of the tile and the cut away portion of the roll portion of this tile extending from the said end of the tile.

The invention also provides a tiled roof comprising a plurality of parallel regularly spaced tile supporting battens extending generally horizontally along the roof and a plurality of roofing tiles as described above in which the tiles are arranged in vertical rows hung on the battens, the tiles in adjacent vertical rows being staggered with respect to each other and being hung on the battens by different ones of the two nibs.

Preferably the tiles in first alternate ones of said vertical rows of tiles are hung on said battens by said one nib which is adjacent on end of the tile and and the tiles in second alternate ones of said vertical rows of tiles are hung on said battens by the other nib, the free edge of the roll portion of the tiles in said second rows being shorter than the free edge of the roll portion of the tiles in said first rows.

In this embodiment the free edge of the roll portion of the tiles in said second rows is shortened by the thickness of the flat portion of the tiles in said first rows so that the tiles in said second rows may overlap these in said first rows along the line of the battens while still ensuring that the flat portions of the tiles rest on the battens with the appropriate nibs engaging the battens.

Preferably an additional batten is provided parallel to and midway between the two lowermost battens of the roof, the additional batten being of lesser thickness than the said two lowermost battens. This additional batten is provided to support the lowermost tiles in said second vertical rows while the first vertical rows are completed at their lower ends by short tiles, the lower edges of which align with the lower edge of said lowermost tiles in said second rows.

Further features and advantages of the invention will be apparent from the following description, by way of example, of a preferred embodiment of a roofing tile according to the invention and a roof constructed of such tiles, the description being read with reference to the accompanying drawings, in which:

FIG. 6 is a side view of the tile in the direction of arrow 5 in FIG. 1;

FIGS. 7 and 8 are views similar to FIGS. 1 and 3 of a modified tile;

Figure 1:
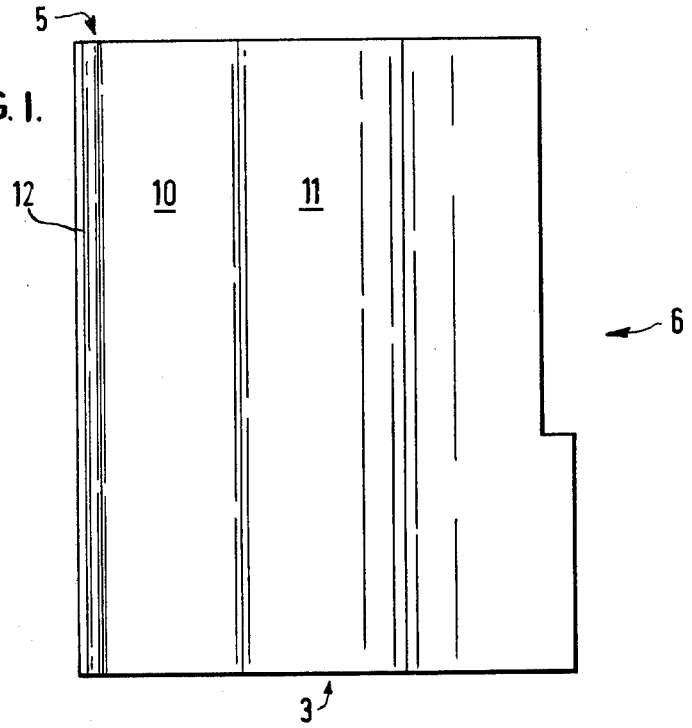
FIG. 1 is a plan view of a roofing tile according to the invention.
Figure 3:
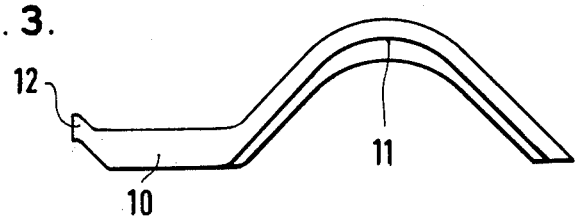
FIG. 3 is an end view of the tile in the direction of arrow 3 in FIG. 1.
Figure 4:
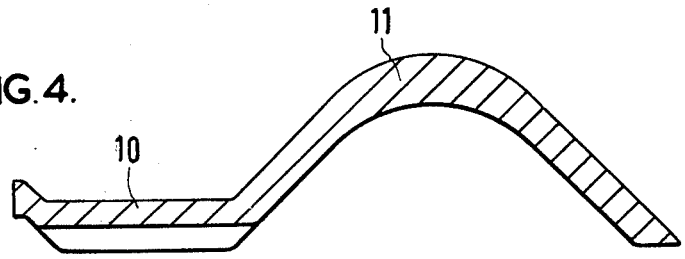
FIG. 4 is a section along the line 4—4 of FIG. 2.

Referring to the drawings, and first to FIGS. 1 to 6, a moulded concrete roofing tile 5 comprises a flat portion 10 and a roll portion 11. The flat portion 10 is provided with an upturned edge 12.

On its underside (see FIG. 2) the tile is provided with projecting nibs 14 and 15 which are formed on the flat portion 10 of the tile and are spaced apart along the length of the tile, nib 14 being adjacent one end of the tile and nib 15 being between the centre of the tile and the nib 14, rather closer to the centre.

The underside of the tile is also provided in the normal way with projecting ribs 16, 17 and 18 which extend across the flat portion 10 of the tile and with further ribs 19, 20, 21 and 22 which extend across the underside of the roll portion 11 of the tile. All these ribs give the tile strength and rigidity and also prevent capillary flow of water from one tile to another adjacent aligned tile in known manner.

The roll portion 11 of the tile is cut away at 25 to provide a profiled edge 26 for a purpose which will be described below. Longitudinal ribs 27, 28 are provided on the underside of the tile parallel to and equidistantly spaced from the two portions of the profiled edge.

Figure 2:
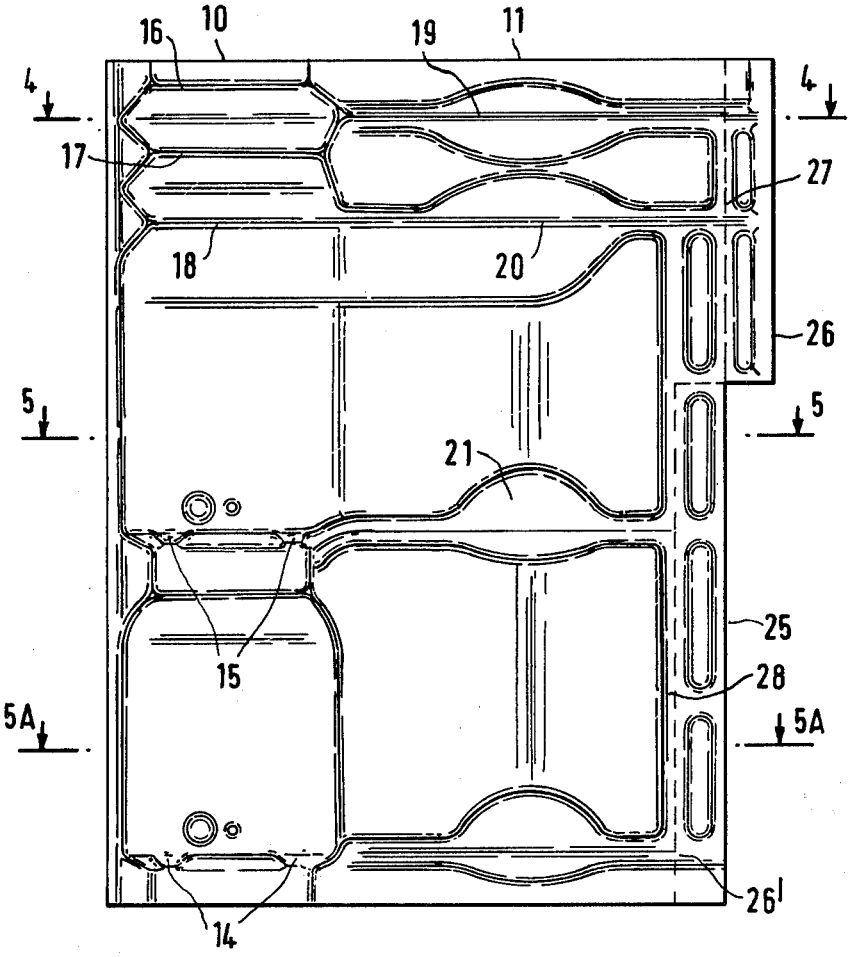
FIG. 2 is an underplan of the tile of FIG. 1.

The modified tile 50 shown in FIGS. 7 and 8 is similar in basic form to tile 5 but is narrower. The underside view of tile 50 is as shown in FIG. 2 with the profiled edge 26′ of the modified tile 50 being indicated by a dotted line. It will be appreciated that the modified tile 50 may be formed in the same mould as the basic tile 5 by using an insert which abuts this line and the longitudinal ribs 27, 28 are provided to form a thickened portion of the tile where the edge of the modified tile is as well as for strengthening the basic tile. The part of the roll portion 11 which is cut away to form the modified tile 50 is equal to the thickness of the flat portion of a tile 5.

Figure 9:
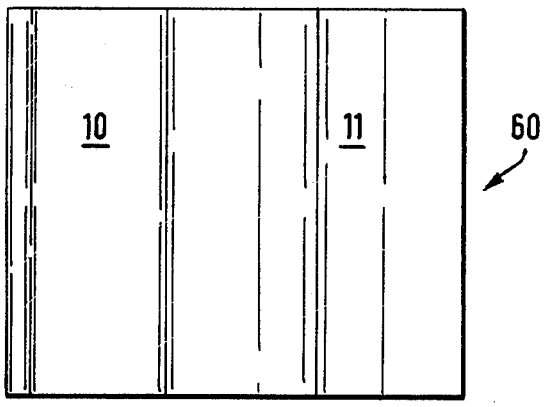
FIG. 9 is a plan view of a short tile.
Figure 10:
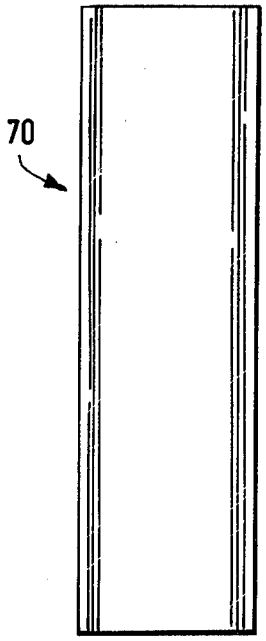
FIGS. 10 and 11 are a plan view and an end view respectively of a trough tile.

The basic tile and modified tile described above and used together to form a roof and two further types of tile may also be used in such roofs. These further tiles are a short tile (FIG. 9) and a trough tile (FIGS. 10 and 11).

Figure 5:
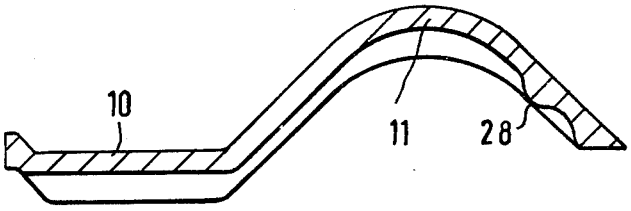
FIG. 5 is a section along the lines 5—5 and 5A—5A of FIG. 2.

The short tile 60 is equivalent to the portion of tile 5 the edge of which is cut away at 25. That is to say, the cross-section of short tile 60 is as illustrated in FIG. 5 and its length is approximately equal to the cut away portion 25.

Figure 11:
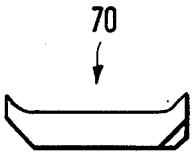

The trough tile 70 is equal in length to the basic tile 5 and modified tile 50 and it has the profile illustrated in FIG. 11. The purpose of the short tile and the trough tile will be described below.

The construction of a roof embodying the tiles of FIGS. 1 to 11 will now be described with reference to FIGS. 12 and 13. The frame-work of the roof 29 is constructed including a number of battens 30, 31, 32 in the usual way. An extra batten 33 is also fixed to the rafters (not shown) parallel to the other battens. The batten 33, which is fixed midway between the two battens 30, 31 closest to the edge of the roof, is thinner than the remaining battens as shown in FIG. 13, the difference in thickness being half the thickness of a tile 5. The tiles are then hung as follows. A vertical row of trough tiles 70 (not shown in FIG. 12) is first hung in mutually overlapping relation up the roof at the right hand edge of the roof. Next, a vertical row of basic tiles 5 is hung on the battens 30, 31, 32. A short tile 60 is hung on batten 30 with its roll portion 11 resting in the lowermost trough tile 70. A basic tile 5 is then hung from batten 31 using nib 14, overlapping the trough tiles and the short tile 60. The rest of the vertical row of basic tiles 5 is then hung in similar fashion progressing up the roof.

An adjacent vertical row of modified tiles 50 is then formed on the battens, the lowermost modified tile being hung by nib 14 from batten 33 and the remaining tiles 50 being hung from battens 31, 32 etc. by nib 15. In this way, the two rows of tiles 5, 50 are staggered in relation to one another. Further rows of tiles 5, 50 are then hung in similar fashion until the roof is completed.

Figure 12:
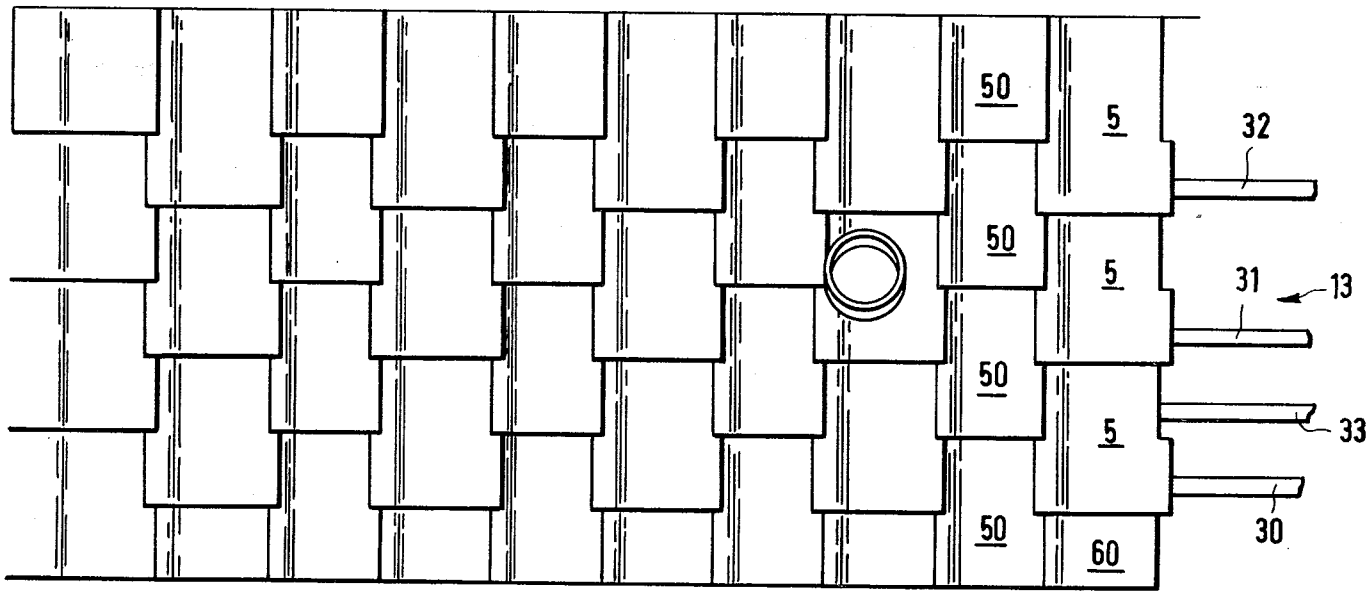
FIG. 12 is a plan view of a roof constructed of a number of tiles as shown in FIGS. 1 to 9.
Figure 13:
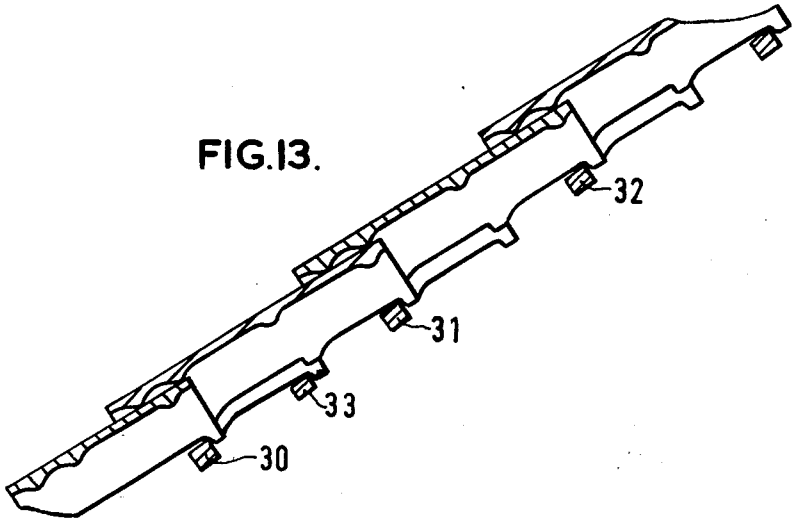
FIG. 13 is a view in the direction of arrow 13 in FIG. 12.

As will be appreciated from FIG. 12, the cut away portions 25 of the roll portions 11 of the tiles 5, 50 receive part of the flat portions 10 of tiles 50, 5 which are diagonally adjacent up the roof. It will also be noted that the upturned edges 12 of the tiles prevent lateral flow of water into the spaces between the tiles.

It will further be appreciated that provision of two main types of tile, basic 5 and modified 50, is necessary because of the "diagonal" overlap of adjacent tiles in order to ensure that all the tiles rest on the battens 30–33.

Figure 12A:
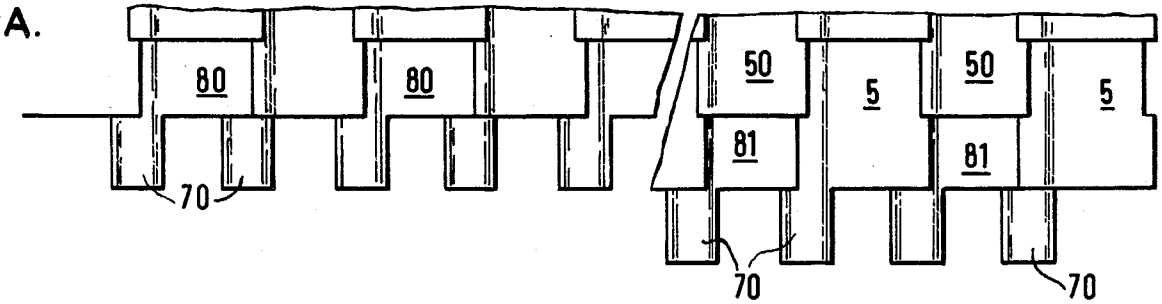
FIG. 12A is a partially broken away view similar to FIG. 12 but showing a roof including the tiles of FIGS. 10 and 11.

Although not illustrated in FIG. 12, the usual finish of the lower edge of the roof, i.e. barge boards with gutters, may be provided. Alternatively, this lower edge may be finished as shown in FIG. 12*a*. In this alternative finish, a trough tile 70 is secured under the edge of the roll portion 11 of the lowermost tile of such vertical row. In order to accommodate these trough tiles, alternate lowermost tiles must be replaced by gargoyle tiles, 80, 81 (that is tiles without the flat portion 10), the gargoyle tiles 80, 81 corresponding to the profile of basic tiles or modified tiles respectively depending on which alternate tiles are replaced.

A roof formed from tiles as described above simulate a roof made from the sort of clay tiles which are commonly found in Southern France where the clay tiles are laid in staggered formation. In this way it is possible to form a roof having all the advantages of moulded concrete tiles yet having a traditional appearance.

The invention is not limited to the preferred embodiment described above and various modifications may be made. For example, in practice, the roof may be tiled not by hanging complete vertical rows of tiles as described, but by hanging a few tiles of a first vertical row, then a few of the second row and the third row and then returning to the first row. It will be appreciated that while this hanging sequence is the same in principle as that described it requires less moving across the roof on the part of the tiler.

I claim:

1. A moulded concrete roofing tile having at least two projecting nibs on the underside of the tile which nibs are spaced apart along the length of the tile whereby the tile may be hung on a batten from either nib, an edge portion of the tile being cut away to receive a portion of a second tile in a vertical row adjacent a vertical row occupied by the said tile end staggered with regard to the said tile, the tile comprising a flat portion and a roll portion in side-by-side relation, the cut away edge portion being on the roll portion.

2. A roofing tile as claimed in claim 1 in which the nibs are formed on the underside of the flat portion of the tile, one being adjacent an end of the tile and the cut away portion of the roll portion of the tile extends from the said end of the tile.

3. A tile roof comprising a plurality of parallel regularly spaced tile supporting battens extending generally horizontally along the roof and a plurality of roofing tiles, each tile being of moulded concrete and having at least two projecting nibs on the underside of the tile which nibs are spaced apart along the length of the tile whereby the tile may be hung on a batten from either nib, an edge portion of the tile being cut away to receive a portion of a second tile in a vertical row adjacent a vertical row occupied by the said tile end staggered with regard to the said tile, the tiles being arranged in vertical rows hung on the battens, the tiles in adjacent vertical rows being staggered with respect to each other and being hung on the battens by different ones of the two nibs.

4. A tiled roof as claimed in claim 3 in which the tiles each have a flat portion and a roll portion in side-by-side relation, the nibs being formed on the underside of the flat portion with one adjacent an end of the tile and the cut-away edge portion being on the roll portion of the tile and extending from the said end of the tile.

5. A tiled roof as claimed in claim 4 in which the tiles in first alternate ones of said vertical rows of tiles are hung on said battens by said one nib and the tiles in second alternate one of said vertical rows of tiles are hung on said batten by the other nib, the free edge of the roll portion of the tiles in said second rows being shorter than the free edge of the roll portion of the tiles in said first rows.

6. A tiled roof as claimed in claim 4 in which an additional batten is provided parallel to and midway between the two lowermost battens of the roof, the additional batten being of lesser thickness than the said two lowermost battens.

* * * * *